US007175397B2

(12) United States Patent
Claude et al.

(10) Patent No.: US 7,175,397 B2
(45) Date of Patent: Feb. 13, 2007

(54) EFFERVESCENT GAS BLEEDER APPARATUS

(75) Inventors: Cordell E. Claude, Hamlin, NY (US); Stephen B. Muscarella, Henrietta, NY (US); Patrick F. Miller, Spencerport, NY (US)

(73) Assignee: Pulsafeeder, Inc., Rochester, NY (US)

( * ) Notice: Subject to any disclaimer, the term of this patent is extended or adjusted under 35 U.S.C. 154(b) by 1 day.

(21) Appl. No.: 10/410,935

(22) Filed: Apr. 10, 2003

(65) Prior Publication Data

US 2004/0062662 A1 Apr. 1, 2004

Related U.S. Application Data

(60) Provisional application No. 60/414,183, filed on Sep. 27, 2002.

(51) Int. Cl.
*F04B 49/22* (2006.01)

(52) U.S. Cl. ..... 417/279; 417/440; 417/53

(58) Field of Classification Search ..... 417/279, 417/440, 53

See application file for complete search history.

(56) References Cited

U.S. PATENT DOCUMENTS 2,978,149 A * 4/1961 Rosen ..... 222/318
3,623,661 A 11/1971 Wagner
4,184,809 A 1/1980 Kelley
4,378,201 A 3/1983 Quarve
4,599,049 A 7/1986 Gordon et al.
4,722,230 A 2/1988 Krohn
5,186,615 A 2/1993 Karliner
5,205,722 A 4/1993 Hammond
5,647,733 A 7/1997 Augustyn et al.
5,667,368 A 9/1997 Augustyn et al.
5,860,793 A 1/1999 Muscarella et al.
6,086,340 A * 7/2000 Edwards et al. ..... 417/440
6,345,962 B1 2/2002 Sutter

FOREIGN PATENT DOCUMENTS

EP 0427988 5/1991

* cited by examiner

*Primary Examiner*—Charles G. Freay
(74) *Attorney, Agent, or Firm*—Hodgson Russ LLP

(57) ABSTRACT

A diaphragm metering pump suitable for metering an effervescent gas. The pump has a pump head with a product chamber having an inlet end with a one-way inlet valve and an outlet end with a one-way outlet valve. A displaceable diaphragm member defines a boundary of the product chamber. The diaphragm member is capable of being reciprocated to cause pumping displacements. A discharge side is disposed downstream from the outlet valve. A passageway is disposed in fluid communication between the discharge side and the product chamber. A valve is disposed in the passageway. The valve is opened intermittently to allow liquid to re-enter the product chamber in an amount effective to purge gas from the product chamber to prevent loss of prime.

24 Claims, 4 Drawing Sheets

EFFERVESCENT GAS BLEEDER APPARATUS

CROSS-REFERENCE TO RELATED APPLICATION

Applicant hereby claims priority based on U.S. Provisional Application No. 60/414,183 filed Sep. 27, 2002, entitled "Effervescent Gas Bleeder Apparatus" which is incorporated herein by reference.

BACKGROUND OF THE INVENTION

The present invention generally relates to liquid metering pumps for delivering controlled amounts of liquid from one vessel to another, or from a source of supply to a process stream. More particularly, it relates to a new and improved effervescent gas bleeder apparatus for use on a liquid metering pump to prevent the metering pump from "air binding" or losing prime.

Diaphragm metering pumps are known and used for transferring fluids from one place to another. Generally, diaphragm pumps include a pumping head area including a product chamber bounded on one side by a displaceable diaphragm member. The inlet and exit to the product chamber are provided with one way check valves. As the diaphragm is displaced away from the product chamber, the exit check valve closes under reduced pressure, the inlet check valve opens and fluid is drawn into the product chamber. Thereafter, as the diaphragm is displaced toward the product side, pressure increases on the fluid in the product chamber, closing the inlet check valve, opening the outlet check valve and forcing fluid in the product chamber out of the exit. In continuous operation, a diaphragm pump pumps fluid through the product side in a pulsed manner.

Diaphragm displacements may be achieved with a mechanical drive system or a hydraulic drive system. An example of a mechanical drive is a solenoid-actuated pump. In a solenoid-actuated pump, an actuator rod is secured at one end to the diaphragm and at its opposed end is connected to a solenoid actuator. The electrically or electronically-controlled solenoid is effective to cause reciprocal linear movement of the actuator and actuator rod thereby causing displacements of the diaphragm directly. As an alternative, a mechanical drive system may include a motor, gearbox, and eccentric cam for driving the actuator rod.

In a hydraulically driven diaphragm metering pump, diaphragm displacement is achieved by varying the pressure of a hydraulic fluid on the hydraulic side of the diaphragm through operation of a reciprocating piston disposed in fluid communication with a hydraulic chamber. Instead of direct mechanical attachment to the diaphragm, with this type of pump, a hydraulic fluid is pressurized on one side of the diaphragm to cause diaphragm displacements toward or away from the product chamber. This also results in a pulsed pumping of a fluid through the pump head.

A problem which may arise in diaphragm metering pumps occurs during operation if a volume of air is sucked into the intake lines so that air travels through the suction line, or after sitting idle, gas accumulates in the pump head or in the suction line below the pump. Air or gas in the intake or pump head may cause the pump to lose prime. For effervescent fluids such as Sodium Hypochlorite and Hydrogen Peroxide, the reciprocating type pumps are very susceptible to "air binding" and losing prime. If the pump loses its prime and gas fills the diaphragm metering pump head area, pumping displacements of the diaphragm may simply compress the gas and not result in any liquid pumping or fluid flow. The compressibility of gases causes this effect. If there is a loss of priming, frequently a pump cannot regain hydraulic firmness and restart pumping.

DETAILED DESCRIPTION

Figure 1:
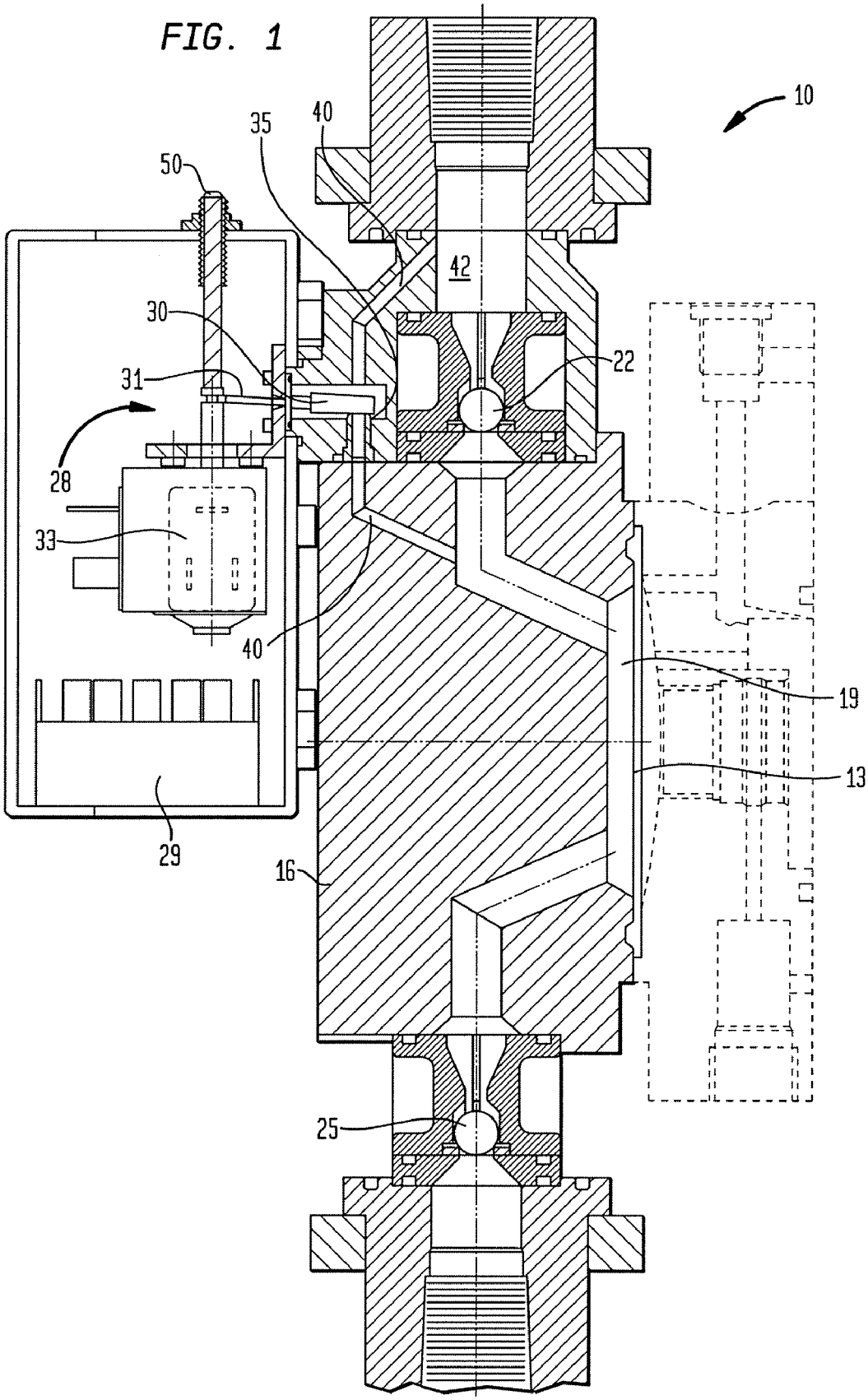
FIG. 1 is a cross-sectional view of the pump and effervescent gas bleeder apparatus of the present invention.

A diaphragm metering pump 10 has a reciprocating diaphragm member 13. As will be evident to those of ordinary skill in the art, the movement of the diaphragm 13 changes the pressure in the pump head 16 so that the pump 10 alternates between an intake and discharge portion during each cycle.

The pump head 16 includes a product chamber 19 bounded on one side by a displaceable diaphragm 13. The inlet and exit to the product chamber are provided with one-way check valves. The check valves shown are ball valves but other types of valves exist as known to those of ordinary skill in the art. As the diaphragm 13 is displaced away from the product chamber 19, the exit check valve 22 closes under reduced pressure, the inlet check valve 25 opens and fluid is drawn into the product chamber 19. Thereafter as the diaphragm 13 is displaced toward the product side, pressure increases on the fluid in the product chamber 19, closing the inlet check valve 25, opening the outlet check valve 22 and forcing fluid through the product side in a pulsed manner.

Figure 2:
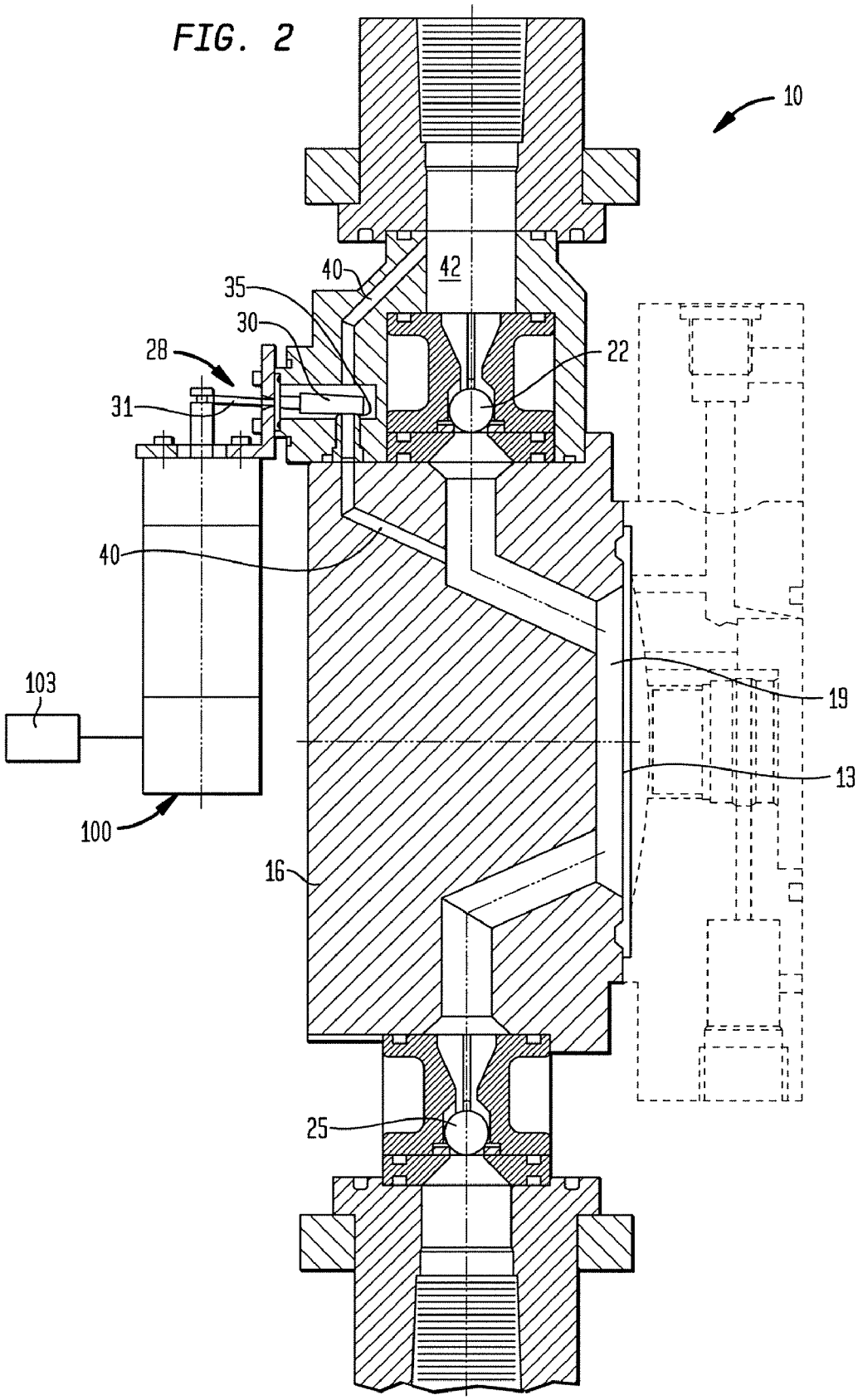
FIG. 2 is a cross-sectional view of an alternate embodiment of the effervescent gas bleeder apparatus of the present invention.
Figure 4:
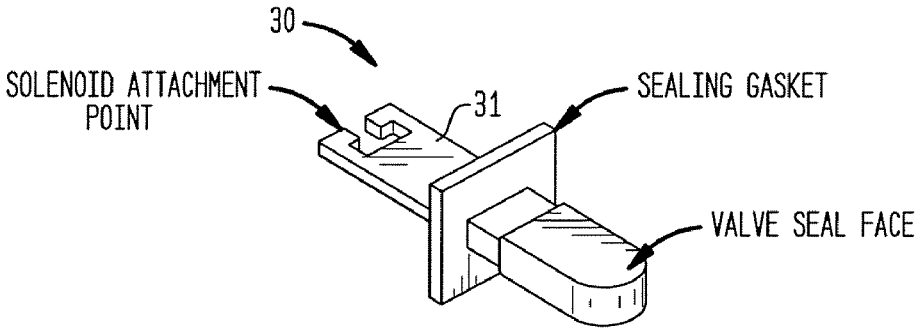
FIG. 4 is a detailed view of the valve element shown in FIGS. 1 and 2.

Referring to FIG. 1, an example of the gas bleeder apparatus of the present invention is a solenoid-operated valve 28 that opens on a regularly timed basis controlled by a repeat cycle timer 29. As an alternative, the valve 28 can be operator controlled or controlled by other means. The solenoid-operated valve 28 is a flapper type valve with a flapper element 30 attached to the end of a lever 31 that is seated on an inlet 35 in its closed position. As shown in FIG. 4, a first end of the lever 31 has a solenoid attachment point and the second end has a valve seal face. A sealing gasket is disposed along a midportion of the lever 31. The gasket seals the valve body in the embodiment shown in FIG. 1. Actuation of the valve 28 by the solenoid 33 causes the flapper element 30 to lift off of inlet 35 to open a passageway 40 that leads from the discharge side 42 of the pump 10 back into the pump head 16. As an alternative (shown in FIG. 2), the valve 28 may also be actuated by a pneumatic or hydraulic cylinder 100 operated by remote valve 103.

The pressure-balanced design of the lever-type flapper valve 28 reduces the size of the solenoid 33 required to actuate the valve 28 and provides a fail-safe system such that the valve 28 will remain closed if the solenoid 33 fails. The flapper element 30 is biased in the closed position by the pressure above the discharge check valve 22. On the intake cycle of the pump 10, the pressure in the pump head 16 is reduced, and as a result, the flapper element 30 is biased in the closed position. During the discharge cycle, the flapper element 30 remains biased in the closed position due to the following factors: gravity, the force developed by a spring acting upon the solenoid plunger, and the equal pressure on both sides of the flapper element 30 that results from the opening of the exit check valve 22. Other types of valve elements can also be used including, but not limited to diaphragm, spool, pintle, ball, or needle valves.

The solenoid-operated valve 28 may be set to actuate for a quarter of a second at regularly timed intervals of approximately thirty seconds. The intervals may be reduced or enlarged. If the intervals are reduced, the wear on the solenoid 33 and flapper element 30 is increased. If the intervals are increased, the gas evacuation time is increased. It has been found that intervals between fifteen and thirty seconds perform well, with the valve 28 being open for a quarter of a second.

Figure 5A:
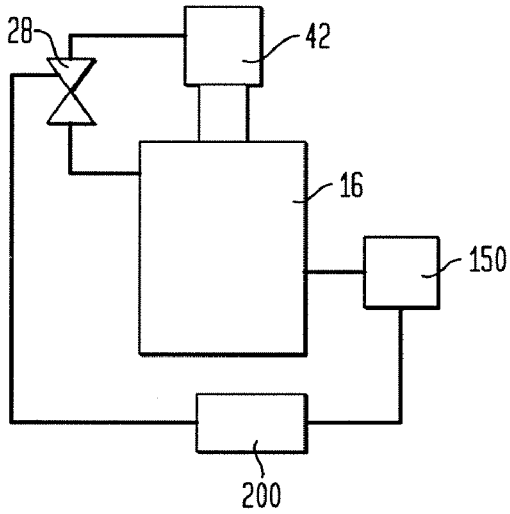
FIG. 5A is a schematic diagram of the present invention controlled by a system responsive to gas detection sensors; and, FIG. 5B is a schematic diagram of the present invention controlled by a system responsive to flow detection devices.
Figure 5B:
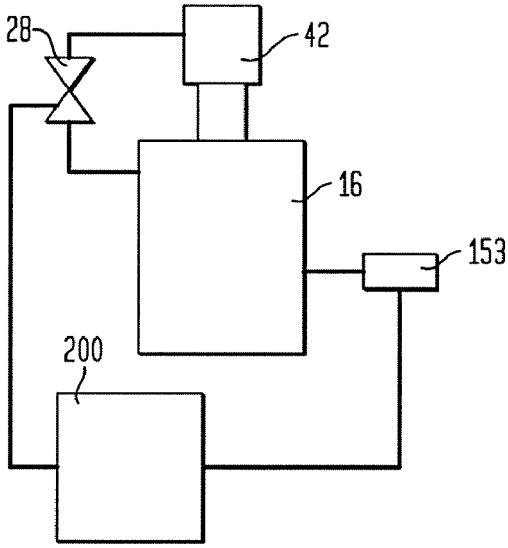

The operation of the valve 28 on timed intervals is independent of the operation of the diaphragm 13 on the pump 10. Accordingly, when the valve 28 opens during certain times the liquid from the discharge side 42 of the pump 10 may return to the pump head 16. At other times, the pressure inside the pump head 16 may cause liquid to pass through the passageway 40 to the discharge side 42 of the pump 10. In alternate embodiments, the opening and closing of the valve 28 may be phased with the movement of the diaphragm 13. Also, as illustrated in FIGS. 5A and 5B, the operation of valve 28 can be tied to a system 200 that is responsive to gas detection sensors 150 or flow detection devices 153 as will be evident to those of ordinary skill in the art.

By providing a valve 28 that opens intermittently, the diameter of the passageway 40 can be increased to avoid problems with clogging. If the passageway is too small, crystallized material can clog the line.

An over-ride control 50 provides for manual control of the valve 28 either electrically or mechanically.

When the gas bleeder apparatus of the present invention is in operation, it allows some liquid from the discharge side 42 of the pump 10 to flow back into the pump 10 which displaces gas from the pump head 16 through the exit valve 22. This prevents the pump 10 from "air binding" or losing prime.

Compression ratio is defined herein as the pressure inside the pump head cavity with the diaphragm extended divided by the pressure in the pump head cavity with the diaphragm retracted. Diaphragm pumps are typically capable of producing only relatively small pressure increases in the pump head due to the relatively small compression ratio and the compressibility of gases.

When the valve 28 is open, the pump head 16 is being pressurized to an approximately equal pressure to the upstream pressure on the other side of the exit check valve 22. By balancing this pressure and adding liquid back into the pump head 16, the small pressure increase generated by the pump diaphragm is enough to open the exit check valve 22.

When a gas bubble is present in the pump head 16 or in the suction line below the pump, the gas bleeder apparatus of the present invention repeats the cycle until all of the gas is purged through the exit check valve 22. The design of the pump head 16 to minimize the internal volume improves the purging of gases because it increases the compression ratio in the pump head 16.

Figure 3:
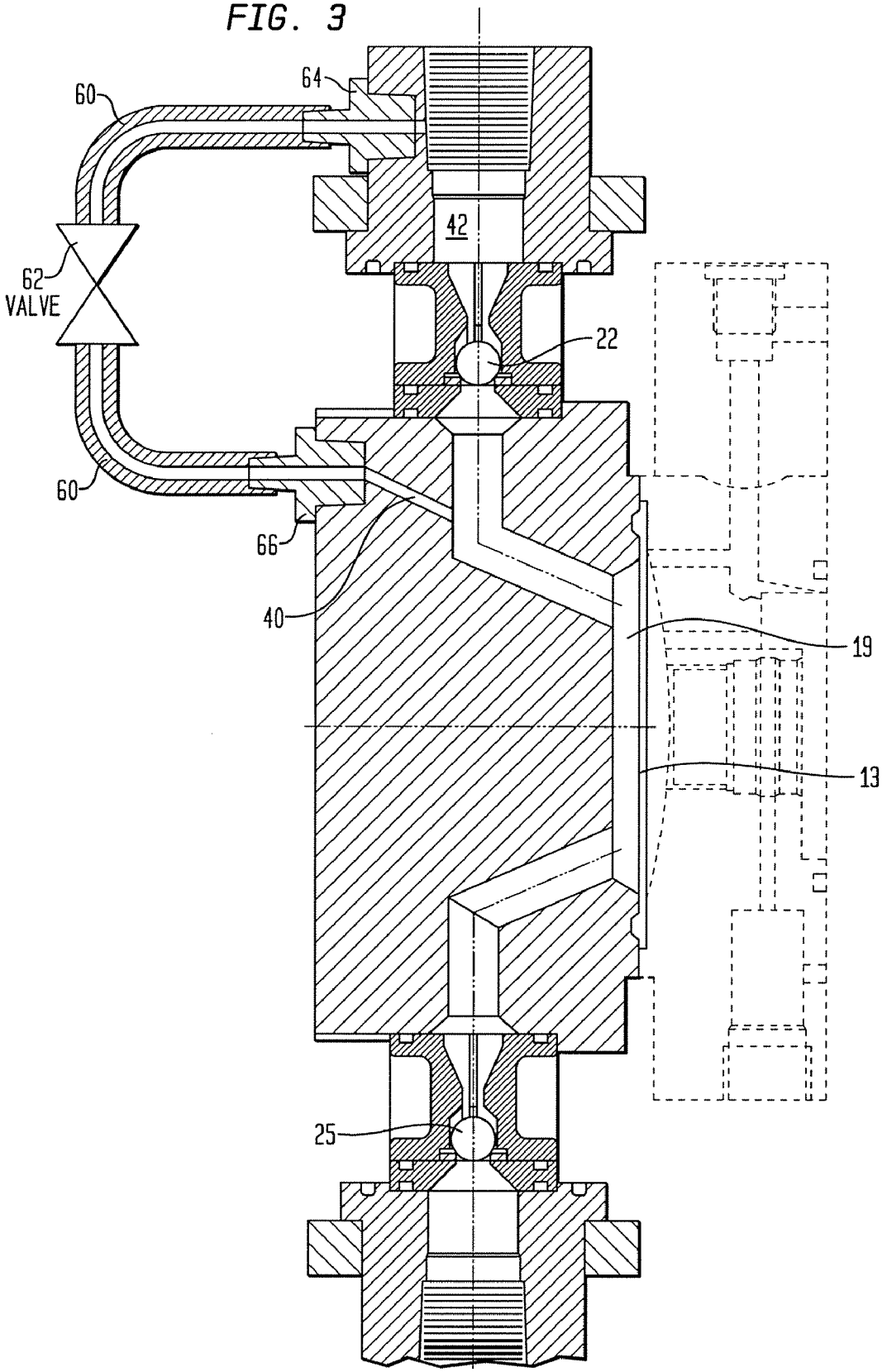
FIG. 3 is a cross-sectional view of another alternate embodiment of the effervescent gas bleeder apparatus of the present invention.

It will be obvious to those of ordinary skill in the art that passageway 40 can be formed in numerous ways. As shown in FIG. 1, the passageway 40 is formed integrally in the body of the pump head 16. As shown in FIG. 3, the passageway 40 could be connected through an external conduit 60 with a bleeder valve 62 positioned somewhere in the line. The external conduit 60 could be connected to the pump head 16 and the discharge side 42 by adapters 64 and 66. Existing diaphragm pumps could be retrofitted in this manner with externally piped gas bleeder valves.

It is also contemplated that the valve 28 could be arranged externally and specially rated for explosive environments.

While the invention has been described in connection with certain embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A diaphragm metering pump, comprising:

a pump head including a product chamber having an inlet end with a one-way inlet valve and an outlet end with a one-way outlet valve;

a displaceable diaphragm member defining a boundary of the product chamber, the diaphragm member capable of being reciprocated to cause pumping displacements;

a discharge side disposed downstream from the outlet valve;

a passageway in fluid communication between the discharge side and the product chamber;

a valve disposed in the passageway; and, wherein the valve is a lever-type flapper valve.

2. The diaphragm metering pump of claim 1, wherein the valve is actuated by a solenoid.

3. The diaphragm metering pump of claim 1, wherein the valve is actuated by a pneumatic cylinder operated by a remote valve.

4. The diaphragm metering pump of claim 1, wherein the valve is actuated by a hydraulic cylinder operated by a remote valve.

5. A diaphragm metering pump, comprising:

a pump head including a product chamber having an inlet end with a one-way inlet valve and an outlet end with a one-way outlet valve;

a displaceable diaphragm member defining a boundary of the product chamber, the diaphragm member capable of being reciprocated to cause pumping displacements;

a discharge side disposed downstream from the outlet valve;

a passageway in fluid communication between the discharge side and the product chamber;

a valve disposed in the passageway; and, wherein the valve is opened such that liquid from the discharge side is conveyed into the product chamber and wherein the valve is automatically opened on an intermittent basis.

6. The diaphragm metering pump of claim 5, wherein the passageway is formed integrally in the pump.

7. The diaphragm metering pump of claim 5, wherein the passageway is connected between adapters in fluid communication with the discharge side and the product chamber.

8. The diaphragm metering pump of claim 5, wherein opening of the valve is synchronized with movement of the diaphragm member.

9. The diaphragm metering pump of claim 5, wherein opening of the valve is asynchronous with movement of the diaphragm member.

10. The diaphragm metering pump of claim 5, wherein opening of the valve is controlled by a system responsive to a gas detection sensor.

11. The diaphragm metering pump of claim 5, wherein opening of the valve is controlled by a system responsive to a flow detection device.

12. A diaphragm metering pump, comprising:

a pump head including a product chamber having an inlet end with a one-way inlet valve and having an outlet end with a one-way outlet valve;

a displaceable diaphragm member defining a boundary of the product chamber, the diaphragm member capable of being reciprocated to cause pumping displacements;

a discharge side disposed downstream of the outlet valve;

a passageway in fluid communication between the discharge side and the product chamber; and, a valve disposed in the passageway, the valve being controlled such that it opens on an intermittent basis to allow liquid to re-enter the product chamber in an amount effective to purge gas from the product chamber to prevent loss of prime; and, wherein the valve is actuated by a solenoid.

13. The diaphragm metering pump of claim 12, wherein the valve is actuated by a pneumatic cylinder operated by a remote valve.

14. The diaphragm metering pump of claim 12, wherein the valve is actuated by a hydraulic cylinder operated by a remote valve.

15. The diaphragm metering pump of claim 12, wherein the passageway is formed integrally in the pump.

16. The diaphragm metering pump of claim 12, wherein the passageway is connected between adapters in fluid communication with the discharge side and the product chamber.

17. The diaphragm metering pump of claim 12, wherein the valve is a lever-type flapper valve.

18. A diaphragm metering pump, comprising:

a pump head including a product chamber having an inlet end with a one-way inlet valve and having an outlet end with a one-way outlet valve;

a displaceable diaphragm member defining a boundary of the product chamber, the diaphragm member capable of being reciprocated to cause pumping displacements;

a discharge side disposed downstream of the outlet valve;

a passageway in fluid communication between the discharge side and the product chamber; and, a valve disposed in the passageway, the valve being controlled such that it opens on an intermittent basis to allow liquid to re-enter the product chamber in an amount effective to purge gas from the product chamber to prevent loss of prime;

wherein the valve is automatically opened on an intermittent basis.

19. The diaphragm metering pump of claim 18, wherein opening of the valve is synchronized with movement of the diaphragm member.

20. The diaphragm metering pump of claim 18, wherein the opening of the valve is asynchronous with movement of the diaphragm member.

21. The diaphragm metering pump of claim 18, wherein the opening of the valve is controlled by a system responsive to a gas detection sensor.

22. The diaphragm metering pump of claim 18, wherein the opening of the valve is controlled by a system responsive to a flow detection device.

23. The diaphragm metering pump of claim 18, wherein the passageway has a smaller cross-sectional area than the product chamber.

24. A method of bleeding an effervescent gas from a diaphragm metering pump, comprising:

providing a pump head including a product chamber having an inlet end with a one-way inlet valve and an outlet end with a one-way outlet valve; a displaceable diaphragm member defining a boundary of the product chamber, the diaphragm member capable of being reciprocated to cause pumping displacements; a discharge side disposed downstream from the outlet valve; a passageway in fluid communication between the discharge side and the product chamber; and, a valve disposed in the passageway; and, opening the valve on an intermittent basis to cause liquid to re-enter the product chamber in an amount effective to purge gas from the product chamber to prevent loss of prime.

* * * * *